US007581986B2

(12) United States Patent
Sakamoto et al.

(10) Patent No.: US 7,581,986 B2
(45) Date of Patent: Sep. 1, 2009

(54) SURFACE-MOUNTED CONNECTOR

(75) Inventors: Nobuyuki Sakamoto, Makinohara (JP); Kazuki Zaitsu, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/332,386

(22) Filed: Dec. 11, 2008

(65) Prior Publication Data

US 2009/0149079 A1 Jun. 11, 2009

(30) Foreign Application Priority Data

Dec. 11, 2007 (JP) ..... 2007-319660

(51) Int. Cl.
*H01R 13/60* (2006.01)

(52) U.S. Cl. ..... 439/570

(58) Field of Classification Search ..... 439/570, 439/566, 563, 571, 572
See application file for complete search history.

(56) References Cited

U.S. PATENT DOCUMENTS 6,042,420 A * 3/2000 Long ..... 439/570
6,227,906 B1 * 5/2001 Fan ..... 439/570
7,121,880 B2 * 10/2006 Sasaki et al. ..... 439/566

FOREIGN PATENT DOCUMENTS

JP 2006-031944 A 2/2006

* cited by examiner

*Primary Examiner*—Phuong K. Dinh
(74) *Attorney, Agent, or Firm*—Sughrue Mion, PLLC

(57) ABSTRACT

A slot 21 is formed on each of both side walls of a connector housing 1. A housing attachment portion 12 of each fixing metal member 10 is inserted into and locked in an associated one of the slots 21. The housing attachment portion 12 is divided by a slit 14 formed in a central part thereof into both side arms 13, each of which has a hook 13*a* provided at the top thereof. Each of the arms 13 is inwardly bent when the associated hook passes through the slot. After the top of each of the arms 13 passes therethrough, each of the arms 13 is restored from the bent condition so as to engage the hooks 13*a* with the associated slot 21. An engaging projection portion 31*a* is provided in an inner wall of each of the slots 21 such that each of the engaging projection portions 31*a* is pushed out to the side of the associated slot 21 and fit into the slit 14 by inserting a mating connector 5 into a connecting concave portion 4 to thereby prevent the arms from being inwardly bent.

3 Claims, 7 Drawing Sheets

SURFACE-MOUNTED CONNECTOR

BACKGROUND OF THE INVENTION

1. Field of the Invention

The present invention relates to a surface-mounted connector mounted on a substrate by soldering fixing metal members, which are respectively attached to both ends of a connector housing, to a substrate.

2. Description of the Related Art

FIG. 9 illustrates a conventional surface-mounted connector described in Patent Document 1. This surface-mounted connector has an insulating resin connector housing 101, which is formed like a substantially rectangular box and is put on a substrate 110, and fixing metal members 103 fixed to side walls of the connector housing 101 by being respectively press-fit into mounting portions 102 provided on outer surfaces of the side walls of the connector housing 101.

Each of the fixing metal members 103 is formed by folding a strip-shaped metal plate cross-sectionally substantially like a letter "L". Each of the fixing metal members 103 has a substrate fixing portion 103*a* to be soldered to a surface of the substrate 110, and a housing attachment portion 103*b* to be attached to an associated one of the mounting portions 102. The surface-mounted connector illustrated in FIG. 9 is mounted on the substrate 110 by soldering the substrate fixing portions 103*a* of the fixing metal members 103 to the substrate 110.

FIGS. 10A and 10B illustrate another example of the conventional surface-mounted connector. FIG. 10A is a perspective view thereof. FIG. 10B is a perspective view of the fixing member. Similarly, in the case of this surface-mounted connector, an L-shaped fixing metal member 123 is inserted from above into each of mounting portions 122 respectively provided on side walls of both ends of a connector housing 121. Then, a housing attachment portion 123*a* of each of the fixing metal members 123 is engaged with an associated one of the mounting portions 122 of the connector housing 121. Further, a substrate fixing portion 123*b* thereof is soldered to the substrate. Thus, this surface-mounted connector is mounted on the substrate.

FIGS. 11A and 11B illustrate another conventional surface-mounted connector. FIG. 11A is a top view thereof. FIG. 11B is a bottom view thereof. This surface-mounted connector is constructed so that fitting metal members 153 are press-fit from below into side walls of both ends of a connector housing 151 on which terminals 152 are mounted.

Patent Document 1: JP-A-2006-31944

Meanwhile, in the case of each of the conventional connectors illustrated in FIGS. 9, 10A and 10B, in which each of the fixing metal members 103 and 123 is press-fit into an associated one of the side walls of the connector housings 101 and 121 from above, each of these conventional connectors has a problem in that the outer shape of the entire conventional connector is large because each of the mounting portions 102 and 122 is formed on the outer surface of an associated one of the side walls of the connector housings 101 and 121. In addition, each of these conventional connectors has another problem in that because each of these conventional connectors has a structure in which each of the fixing metal members 102 and 123 is inserted into an associated one of the mounting portions 102 and 122 from above, the area of each of the substrate fixing portions 103*a* and 123*b* of the fixing metal members 103 and 123 cannot be increased, and that a large force for fixing the connector to the substrate cannot be obtained.

Further, in the case of the conventional connector illustrated in FIGS. 11A and 11B, in which each of the fixing metals 153 is simply press-fit into the connector housing 151 from below in the conventional connector housing 151, this conventional connector has problems in that the fixing metal members 153 easily slip off the connector housing 151, and that a force for holding the fixing metal members 153 is weak.

SUMMARY OF THE INVENTION

The invention is accomplished in the aforementioned view. An object of the invention is to provide a surface-mounted connector that can surely prevent the slip-off of a fixing metal member of a connector, which is inserted into a connector housing thereof from below, by simultaneously suppressing increase in the dimensions of the outer shape of the connector, and that can also assure a force for reliably and fixedly mounting the connector on a substrate.

To achieve the foregoing object, a surface-mounted connector according to the invention is featured in configurations respectively described in the following items (1) and (2).

(1) A surface-mounted connector, mounted on a surface of a substrate by being soldered to the substrate, having a connecting concave portion into which a mating connector is fit. This surface-mounted connector is featured by comprising a connector housing having side walls respectively provided at both ends thereof such that a slot is formed in each of the side walls so as to extend upwardly from a bottom surface of an associated one of the side walls, which faces a substrate when the surface-mounted connector is mounted on the substrate, a plurality of terminals mounted on a portion of the connector housing, which is located between the side walls, and two fixing metal members formed by folding each of two metal plates cross-sectionally substantially like a letter "L", Further, this surface-mounted connector is featured in that each of the fixing metal members includes a substrate fixing portion, a bent portion which is continuously connected to the substrate fixing portion and is cross-sectionally substantially L-shaped, and a housing attachment portion which is continuously connected to the bent portion and is provided so as to be erected via the bent portion with respect to the substrate fixing portion, that each of the fixing metal members is fixed to the connector housing by inserting an associated one of the housing attachment portions into an associated one of the slots from below an associated one of the side walls, that each of the substrate fixing portions of the fixing metal members is a portion to be soldered to the substrate so as to fix the surface-mounted connector to the substrate, that in each of the housing attachment portions of the fixing metal members, a slit extending from a top of the housing attachment portion towards an associated one of the bent portions is formed in a central part in a width direction of the housing attachment portion so as to form a pair of both side arms into which the housing attachment portion is laterally divided, that a hook is formed at a top portion of each of the arms of the pairs so as to protrude outwardly and largely from a width of an associated one of the arms and to engage with a top of an associated one of the slots when an associated one of the fixing metal members is inserted into the associated one of the arms, thereby to prevent the associated one of fixing metal members from downwardly slipping off the associated one of the slots, that the pairs of the arms are configured so that when each of the hooks passes through an associated one of the slots, the pairs of the arms are inwardly bent so as to permit each of the hooks to pass therethrough, and that after each of the hooks passes through the associated one of the slots, the pairs of the arms are restored from an inwardly bent state, thereby to engage each of the hooks with an associated one of the tops of the slots, that an engaging projection portion, which protrudes towards the connecting concave portion and is supported displaceably in a direction perpendicular to an inner wall of an associated one of the slots, is provided on the inner wall of the associated one of the slots, and that each of the engaging projection portions is pushed out towards a corresponding one of the slots by the mating connector to be fit into the connecting concave portion, and is fit into the slit of an associated one of the fixing metal members, which is inserted into a corresponding one of the slots, to thereby prevent the arms from being inwardly bent.

(2) In the aforementioned configuration (1), the engaging projection portion is formed in the engaging arm which has an end connected to an associated one of the side walls of the connector housing and which is formed swingably and integrally therewith.

The surface-mounted connector having the aforementioned configuration described in the item (1) can fix the fixing metal to the connector housing to prevent the slip-off of the fixing metal from the connector housing by inserting each of the housing attachment portions of the fixing metal members into an associated one of the slots formed on the connector housings and by inserting the mating connector into the connecting concave portion. That is, when the housing attachment portions of each of the fixing metal members are inserted into the associated one of the slots, first, the both side arms are inwardly bent, so that the hooks pass through the associated one of the slots. Then, when the hooks pass through the slots and when the arms are restored from the bent state, the hooks engage with the tops of the associated one of the slots. Subsequently, when the mating connector is inserted into the connecting concave portion of the connector housing, each of the engaging projection portions is pushed out by the mating connector towards the associated slot and is fit into the opened slit of the associated housing attachment portion. Thus, the engaging projection portions prevent the arms from being inwardly bent.

Accordingly, the hooks are engaged with the tops of an associated one of the slots to thereby prevent the slip-off of the fixing metal members from the connector housing. Each of the engaging projection portions is fit into the associated slit. Further, the arms are restrained from being inwardly bent. Thus, the hooks are prevented from being disengaged from the top of the associated slot. Accordingly, each of the fixing metal members is doubly locked. Consequently, even in a case where a load acting in a slip-off direction is applied to each of the fixing metal members, the prevention of the slip-off of the fixing metal members can surely be achieved by the action of the engaging projection portions. After each of the fixing metal members is inserted into the associated slot, the engaging projection portions are fit into the slits. Thus, a force required to insert the fixing metal members into the slots can be suppressed as much as possible. Consequently, the surface-mounted connector can smoothly be mounted on the substrate.

Further, the surface-mounted connector according to the invention has a structure in which the fixing metal members are inserted from below into the connector housing. Thus, as compared with the structure in which the fixing metal members are inserted into the mounting portions from above, the structure according to the invention can reduce the size of the slots serving as the mounting portions. Consequently, increase in the dimensions of the outer shape of the connector housing can be suppressed. In addition, the area of the substrate fixing portion of each of the fixing metal members can be increased. Accordingly, the surface-mounted connector according to the invention can reliably be fixed to the substrate.

In the case of the surface-mounted connector having the configuration described in the item (2), when the mating connector is inserted into the connecting concave portion of the connector housing, the engaging projection portion of each of the engaging arms formed swingably and integrally with the connector housing is pushed out towards the associated slot and is fit into the opened slit of the associated housing attachment portion. Consequently, the engaging projection portions prevent the arms from being inwardly bent. Thus, the engaging arms each having the engaging projection portion are formed integrally with the connector housing. Accordingly, a highly reliable structure for preventing the slip-off of the fixing metal members can be obtained without increasing the size of the connector housing.

According to the invention, the slip-off of a fixing member, which is inserted into a connector housing from below, can surely be prevented by simultaneously suppressing increase in the dimensions of the outer shape of the connector. In addition, a force for reliably and fixedly mounting the connector on a substrate can be assured.

In the foregoing description, the invention has briefly been described. However, details of the invention will be further clarified by reading thorough the following description of a best mode for carrying out the invention by referring to the accompanying drawings.

BRIEF DESCRIPTION OF THE DRAWINGS

FIG. 4A is a perspective view, taken from a front side, illustrating this fixing metal member. FIG. 4B is a perspective view, taken from a rear side, illustrating this fixing metal member.

DESCRIPTION OF THE PREFERRED EMBODIMENTS

Hereinafter, preferred embodiments of the invention are described in detail with reference to the accompanying drawings.

Figure 1:
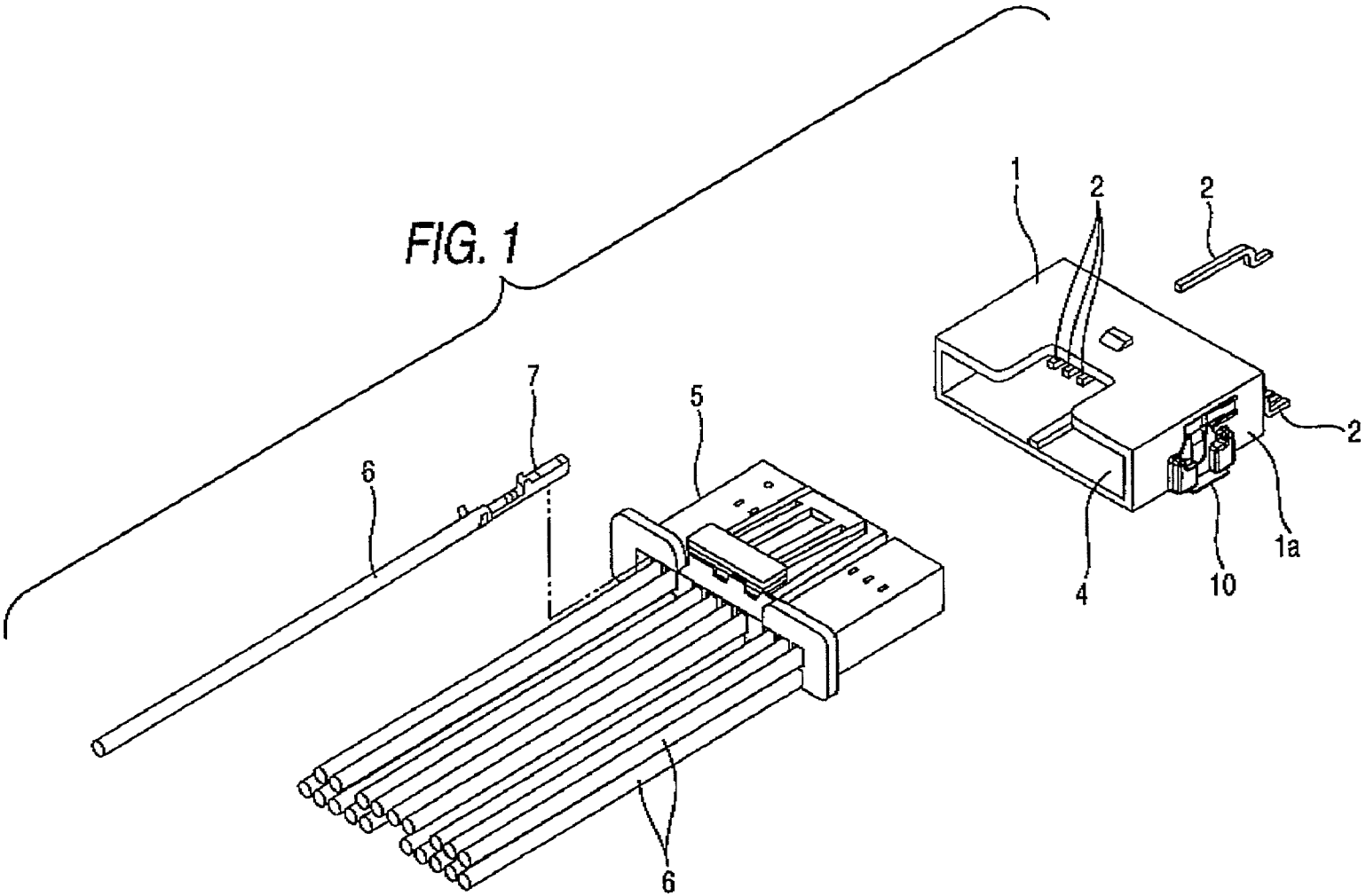
FIG. 1 is a perspective view illustrating a surface-mounted connector according to an embodiment of the invention and a connector to be connected thereto.
Figure 2:
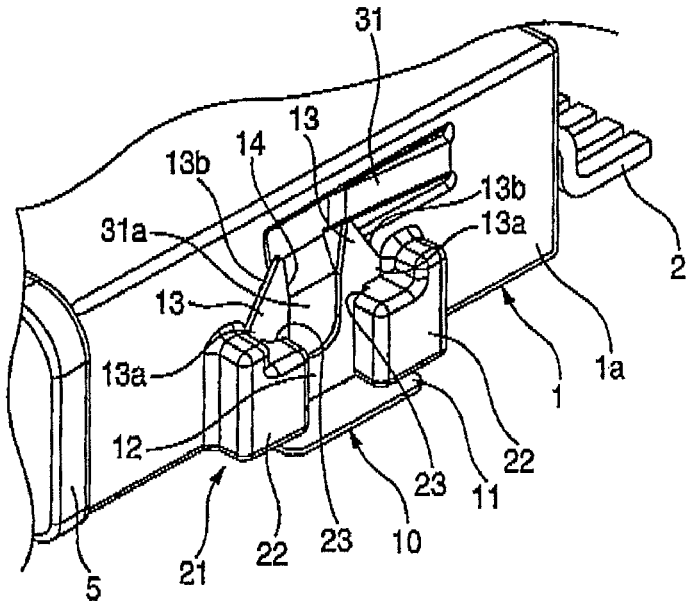
FIG. 2 is a perspective view illustrating a place at which the surface-mounted connector illustrated in FIG. 1 is mounted on a substrate.
Figure 3:
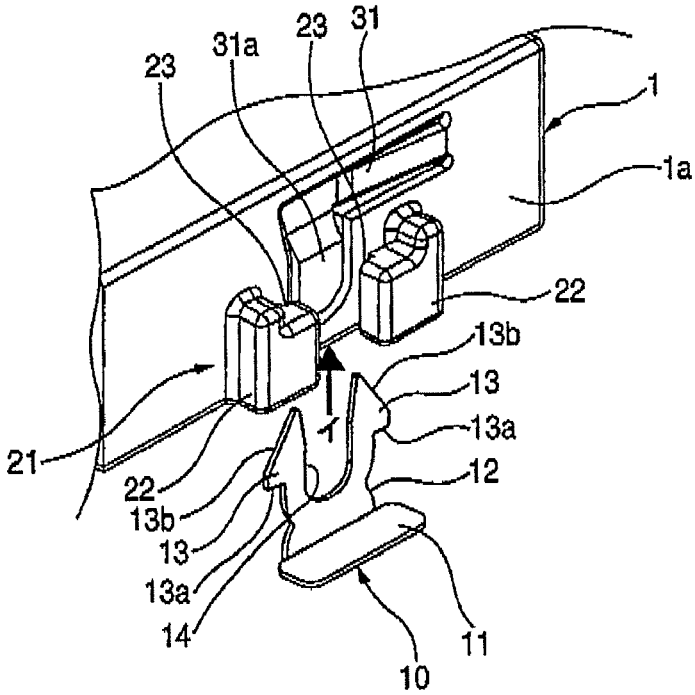
FIG. 3 is a perspective view illustrating a structure for fixing the surface-mounted connector illustrated in FIG. 2 to the substrate.
Figure 4A:
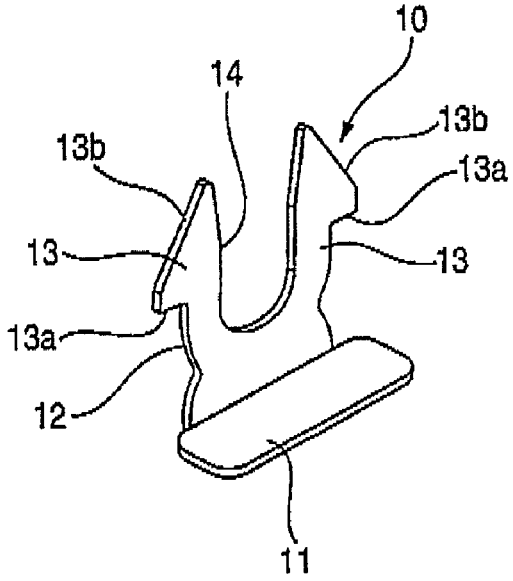
FIGS. 4A and 4B illustrate a fixing metal member to be inserted into a slot of the surface-mounted connector illustrated in FIG. 1.
Figure 4B:
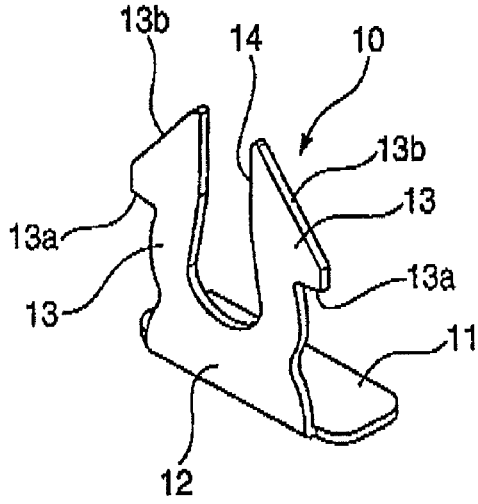
Figure 5:
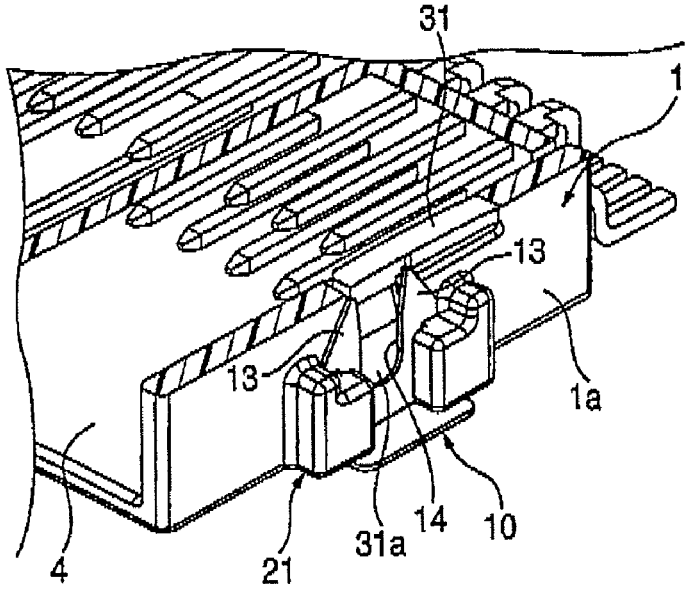
FIG. 5 is a partially cross-sectional perspective view illustrating an engaging structure of the fixing metal member of the surface-mounted connector illustrated in FIG. 1.
Figure 6:
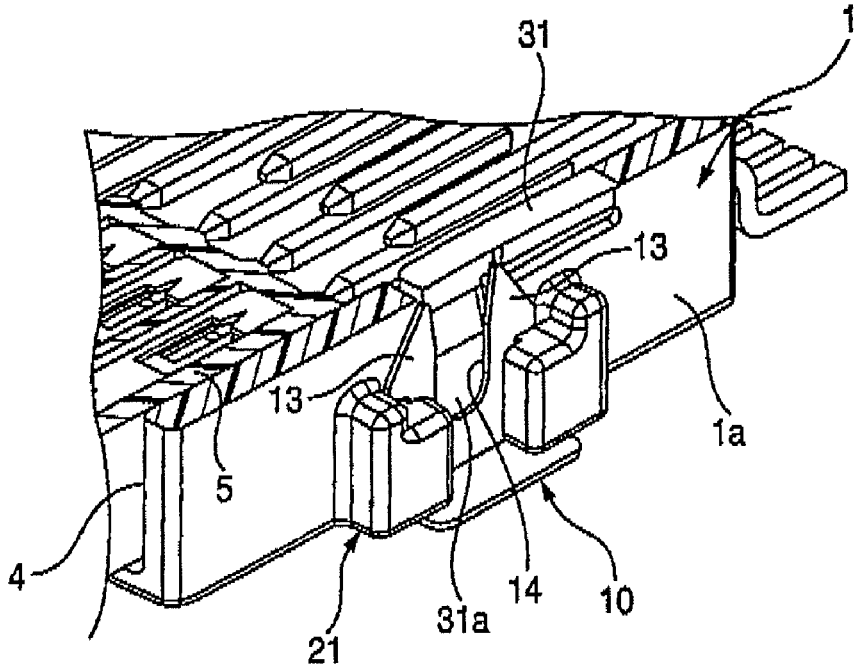
FIG. 6 is a partially cross-sectional perspective view illustrating a method for engaging the fixing metal member of the surface-mounted connector illustrated in FIG. 1.
Figure 7:
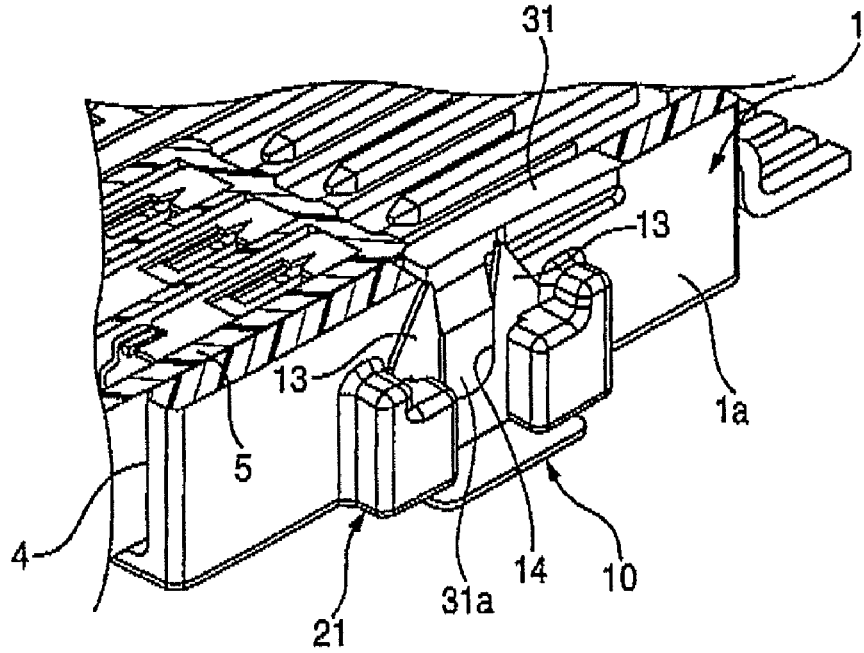
FIG. 7 is another partially cross-sectional perspective view illustrating the method for engaging the fixing metal member of the surface-mounted connector illustrated in FIG. 1.
Figure 8:
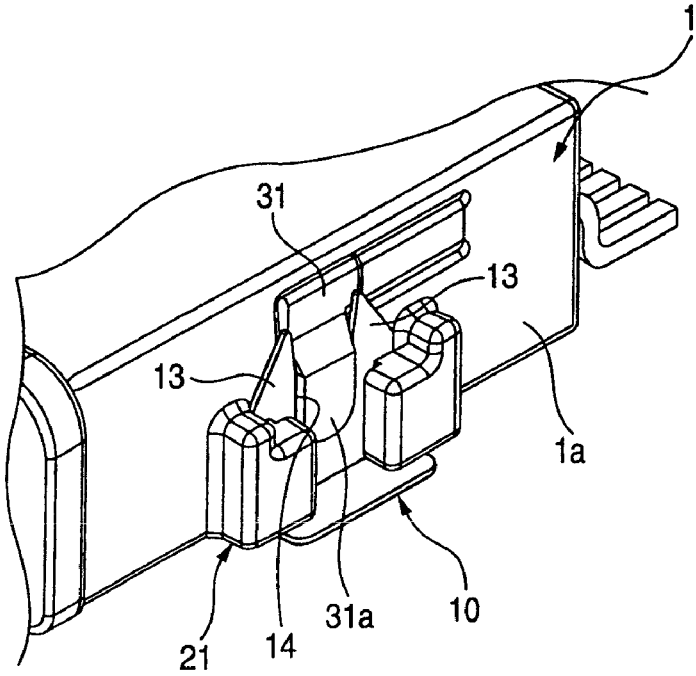
FIG. 8 is a perspective view illustrating a state in which the fixing metal member of the surface-mounted connector illustrated in FIG. 1 engages with a mating connector.
Figure 9:
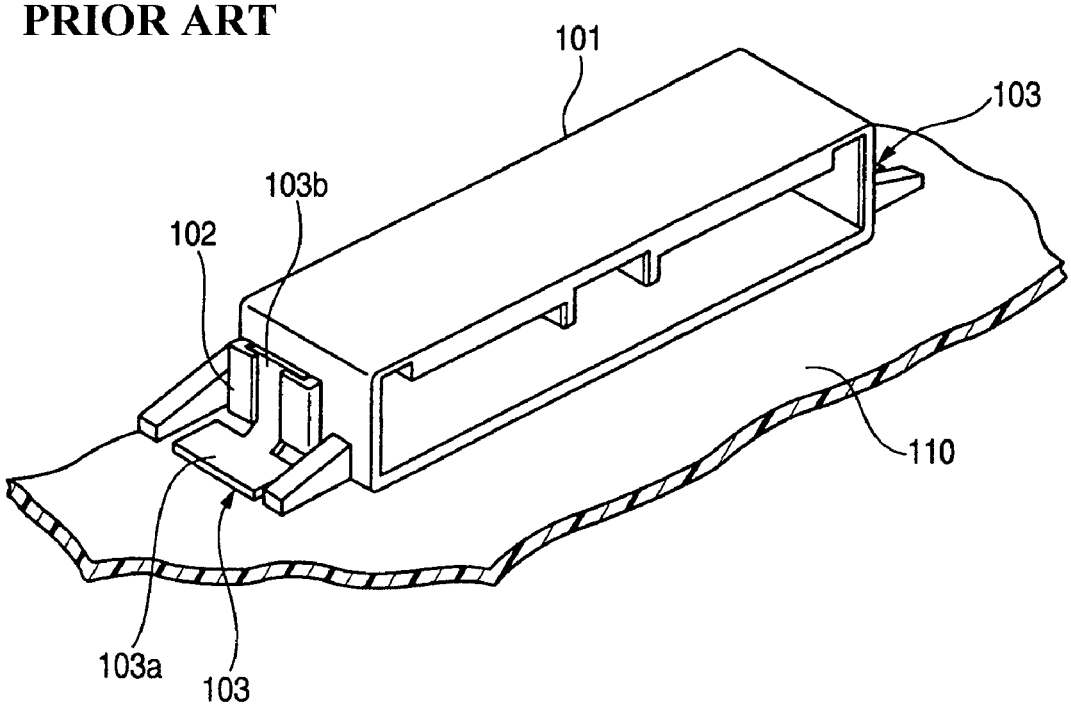
FIG. 9 PRIOR ART
FIG. 9 is a perspective view illustrating a conventional surface-mounted connector.
Figure 10A:
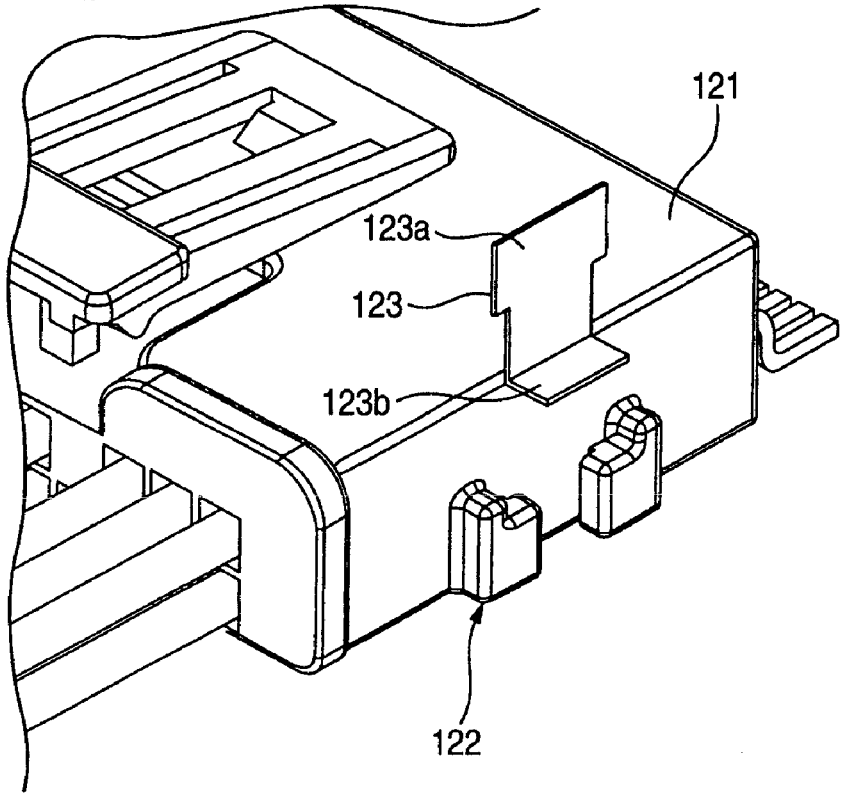
FIG. 10A PRIOR ART
FIG. 10A is a perspective view illustrating another conventional surface-mounted connector.
Figure 10B:
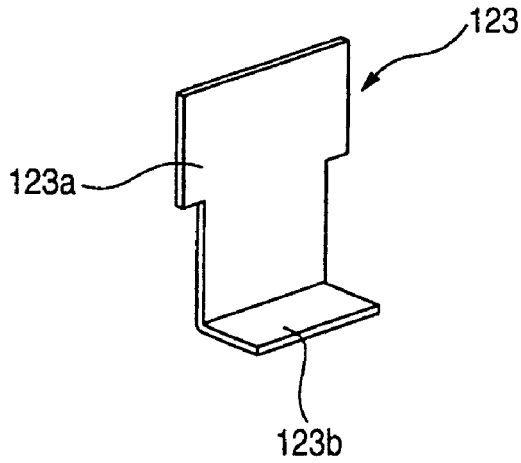
FIG. 10B PRIOR ART
FIG. 10B is a perspective view illustrating a fixing metal member of this conventional surface-mounted connector.
Figure 11A:
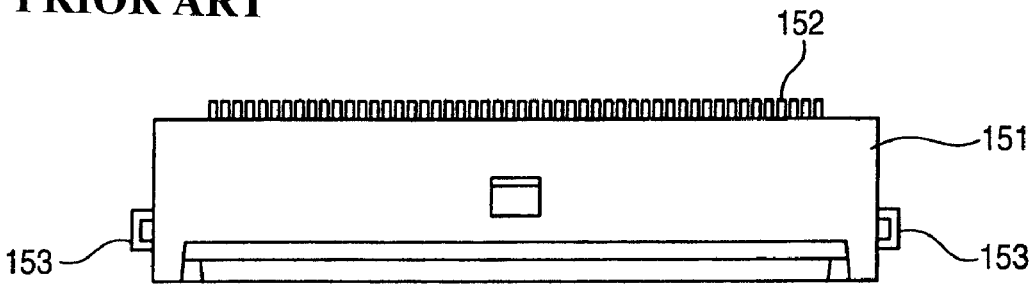
FIG. 11A PRIOR ART
FIG. 11A is a top view illustrating another conventional surface-mounted connector.
Figure 11B:
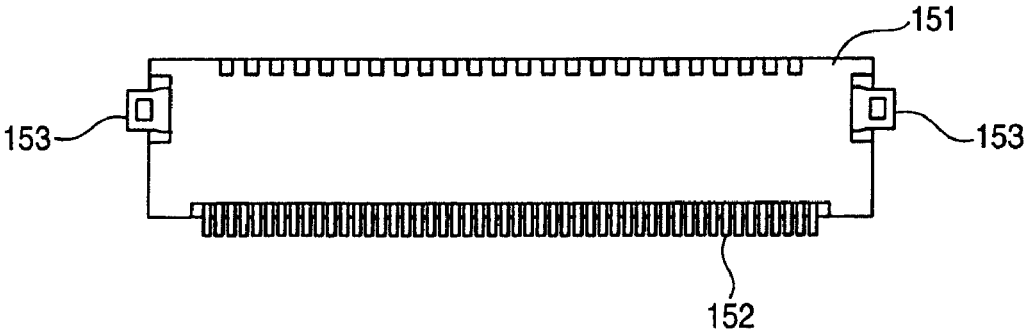
FIG. 11B PRIOR ART
FIG. 11B is a bottom view illustrating this conventional surface-mounted connector.

FIG. 1 is a perspective view illustrating a surface-mounted connector according to an embodiment of the invention and a connector to be connected thereto. FIG. 2 is a perspective view illustrating a place at which the surface-mounted connector illustrated in FIG. 1 is mounted on a substrate. FIG. 3 is a perspective view illustrating a structure for fixing the surface-mounted connector illustrated in FIG. 2 to the substrate. FIGS. 4A and 4B illustrate a fixing metal member to be inserted into a slot of the surface-mounted connector illustrated in FIG. 1. FIG. 4A is a perspective view, taken from a front side, illustrating this fixing metal member. FIG. 4B is a perspective view, taken from a rear side, illustrating this fixing metal member. FIG. 5 is a partially cross-sectional perspective view illustrating an engaging structure of the fixing metal member of the surface-mounted connector illustrated in FIG. 1. FIG. 6 is a partially cross-sectional perspective view illustrating a method for engaging the fixing metal member of the surface-mounted connector illustrated in FIG. 1. FIG. 7 is another partially cross-sectional perspective view illustrating the method for engaging the fixing metal member of the surface-mounted connector illustrated in FIG. 1. FIG. 8 is a perspective view illustrating a state in which the fixing metal member of the surface-mounted connector illustrated in FIG. 1 engages with a mating connector.

As illustrated in FIG. 1, this surface-mounted connector includes a connector housing 1 formed using an insulating resin, a plurality of terminals 2 mounted on the connector housing 1, a pair of fixing metal members 10 respectively attached to both end portions in the longitudinal direction of the bottom surface of the connector housing 1. This surface-mounted connector is mounted on a surface of the substrate by soldering the fixing metal members 10 to the substrate.

A connecting concave portion 4 is formed in the connector housing 1. A mating connector 5 is fit into this connecting concave portion 4. A female terminal 7 connected to an electric wire 6 is accommodated in the mating connector 5. The female terminal 7 is connected to the terminal 2 by fitting the mating connector 5 into the connecting concave portion 4 of the connector housing 1.

As illustrated in FIGS. 2 and 3, a slot 21 is formed on each of both side portions of the connector housing 1 such that the slot 21 upwardly extends from the bottom surface of the connector housing 1, which faces a substrate (not shown) on which this connector is mounted. This slot 21 includes a pair of locking blocks 22 formed on each sidewall 1*a* of the connector housing 1. These locking blocks 22 respectively include engaging grooves 23 formed to extend along an up-down direction in parallel to each other.

As illustrated in FIGS. 4A and 4B, each of the fixing metal members 10 formed by folding a strip-shaped metal plate cross-sectionally substantially like a letter "L". Each of the fixing metal members 10 includes a substrate fixing portion 11 to be soldered to a surface of the substrate, and a housing attachment portion 12 to be fixed to the connector housing 1 by being erected via a bent portion flexed at a substantially right angle to this substrate fixing portion 11 and by being inserted from below, as indicated by an arrow designated with katakana character "イ" in FIG. 3, into the engaging groove 23 of the engaging block 22 of the associated slot 21.

Further, in the housing attachment portion 12 of the fixing metal member 10, a slit 14 is formed in a central part in the width direction of the fixing metal member 10 so as to extend from the top thereof towards the bent portion. Thus, the housing attachment portion 12 is divided into a pair of both side arms 13. A hook 13*a* is formed at the top portion of each arm 13 so as to protrude outwardly therefrom by an amount being larger than the width of each inlet portion of the slot 21, and as to engage with the top of the slot 21 when the hook 13*a* is inserted into the slot 21, thereby to prevent the fixing metal member 10 from downwardly slipping off the slot 21. Furthermore, on an outer edge of the top portion of each of the arms 13, a guide chamfered portion 13*b* for facilitating the insertion of the associated arm 13 into the associated inlet portion of the slot 21 is provided.

Additionally, paired both-side arms 13 are constructed so that when each hook 13*a* is passed through the associated inlet portion of the slot 21, an associated one of the arms 13 is inwardly bent thereby to allow each hook 13*a* to pass therethrough, and that after the hooks 13*a* are respectively passed through the inlet portions of the slot 21, the arms 13 are restored from the inwardly bent state to thereby engage the hooks 13*a* with the tops of the slot 21, respectively.

Each sidewall 1*a* of the connector housing 1 is formed integrally with an engaging arm 31 bent like a letter "L". As illustrated in FIG. 5, this engaging arm 31 extends to the front side of the connector housing 1 from a base end thereof connected to the associated sidewall 1*a* by being slightly inclined to the connecting concave portion 4. Further, this engaging arm 31 is downwardly bent therefrom. Consequently, a leading end side portion of this engaging arm 31 is slightly protruded to the inside of the connecting concave portion 4. Additionally, a bent portion downwardly flexed at the front end of the engaging arm 31 is formed as an engaging projection portion 31*a*, and is arranged to be substantially flush with the associated sidewall 1*a* of the connector housing 1.

Next, an operation of the surface-mounted connector is described below. In this surface-mounted connector, the housing attachment portion 12 of each of the fixing metal members 10 is inserted into the associated slot 21 formed on the connector housing 1. Then, a mating connector 5 is inserted into the connecting concave portion 4. Thus, the fixing metal members 10 can be fixed to the connector housing 1 so as to be prevented from slipping off the connector housing 1.

That is, when the housing attachment portion 12 of each of the fixing metal members 10 is inserted into the associated slot 21, first, the both-side arms 13 enter the engaging groove 23 and are inwardly bent, so that the hooks 13*a* pass through the inlet portions of the slots 21, respectively. When each of the housing attachment portions 12 is further inserted thereinto, the top portions of the arms 13 are restored from a state in which the arms 13 are inwardly bent by passing the engaging groove 23. Thus, the hooks 13*a* engage with the tops of the slots 21.

In this state, as illustrated in FIG. 6, the mating connector 5 is inserted into the connecting concave portion 4 of the connector housing 1.

Then, as illustrated in FIG. 7, the mating connector 5 inserted into this connecting concave portion 4 abuts against the engaging arms 31 protruded into the connecting concave portion 4.

When the mating connector 5 is further pushed into the connecting concave portion 4, the engaging arms 31 are pushed outwardly therefrom. As illustrated in FIG. 8, each of the engaging convex portions 31*a* of the engaging arms 31 is pushed out to the associated slot 21 and is fit into the opened slit 14 of the housing attachment portion 12 of an associated one of the fixing metal members 10.

Consequently, the fixing metal member 10 is prevented from being bent to the inside of each of the arms 13 of the housing attachment portion 12 of the fixing metal member 10.

Accordingly, each of the hooks 13*a* is engaged with the top of the associated slot 21. Consequently, each of the fixing metal members 10 is prevented from slipping off the associated slot 21 of the connector housing 1. The engaging projection portion 31*a* of each of the engaging arms 31 is fit into the associated slit 14. Thus, each of the engaging projection portions 31*a* is restrained from inwardly being bent. Consequently, the hooks 13*a* are prevented from being disengaged from the top of each of the slots 21. Thus, the fixing metal members 10 are doubly locked. Accordingly, for example, even in a case where the electric wire 6 of the mating connector 5 is pulled, so that a load acting in a slip-off direction is applied to the fixing metal member 10, the slip-off of the fixing metal member 10 can surely be prevented by the action of the engaging projection portions 31*a*. Further, after each of the fixing metal members 10 is inserted into the associated slot 21, the associated engaging projection portion 31*a* is fit into the associated slit 14. Thus, a force required to insert each of the fixing metal members 10 into the associated slot 21 can be suppressed as much as possible. Consequently, the surface-mounted connector can smoothly be mounted on the substrate.

Further, the surface-mounted connector has a structure in which each of the fixing metal members 10 is inserted from below into the associated one of the slots 21. Thus, the size of each of the slots 21 serving as the mounting portions can be reduced. Consequently, increase in the dimensions of the outer shape of the connector housing 1 can be suppressed. In addition, the area of the substrate fixing portion 11 of each of the fixing metal members 10 can be increased. Accordingly, the surface-mounted connector can surely be fixed to the substrate.

Moreover, each engaging arm 31 having the engaging projection portion 31*a* is formed integrally with the connector housing 1. Thus, increase in the size of the connector housing 1 is not caused. Consequently, the invention can obtain a highly reliable structure for preventing the slip-off of the fixing metal members 10.

Incidentally, the invention is not limited to the aforementioned embodiments. Appropriate modification, improvement, and the like can be made. In addition, the materials, shapes, dimensions, numbers, locations, and the like of constituent elements are optional and are not limited to specific ones, as long as the invention can be implemented.

What is claimed is:

1. A surface-mounted connector to be mounted on a substrate, the surface-mounted connector comprising:

a connecting concave portion into which a mating connector is fit;

a connector housing having a side wall, a slot being formed on the side wall so as to extend upwardly from a bottom surface of the side wall that faces the substrate when the surface-mounted connector is mounted on the substrate; and a fixing metal member including a substrate fixing portion to be fixed to the substrate, a bent portion continuously connected to the substrate fixing portion, and a housing attachment portion continuously connected to the bent portion so as to be erected via the bent portion with respect to the substrate fixing portion, the fixing metal member being fixed to the connector housing by inserting the housing attachment portion into the slot;

wherein a slit is formed from a top of the housing attachment portion toward the bent portion so as to form an arm into which the housing attachment portion is laterally divided; a hook protruding outwardly so as to engage with the slot when the fixing metal member is inserted into the slot, is formed on the arm; the arm is configured so that when the hook passes through the slot, the arm is inwardly bent so as to permit the hook to pass, and that after the hook passes through the slot, the arm is restored from an inwardly bent state so as to engage the hook with the slot;

an engaging projection portion protruding towards the connecting concave portion and displaceably supported in a direction perpendicular to an inner wall of the slot is provided on the inner wall of the slot; and the engaging projection portion is pushed out towards the slot by the mating connector to be fit into the connecting concave portion, and is fit into the slit of the fixing metal member that which is inserted into the slot.

2. The surface-mounted connector according to claim 1, wherein the engaging projection portion is formed in the engaging arm which has an end connected to the side wall of the connector housing and which is formed swingably and integrally therewith.

3. The surface-mounted connector according to claim 1, wherein the substrate fixing portion is a portion to be soldered to the substrate so as to fix the surface-mounted connector to the substrate.

* * * * *